US006515655B1

(12) United States Patent
Thörnblad

(10) Patent No.: US 6,515,655 B1
(45) Date of Patent: Feb. 4, 2003

(54) VIDEO DISPLAY UNIT WITH SWITCHABLE MODE POWER SUPPLY RESPONSIVE TO ACTIVE SYNC SIGNALS

(75) Inventor: Hans Thörnblad, Vallentuna (SE)

(73) Assignee: ICL Systems AB, Kista (SE)

( * ) Notice: Subject to any disclaimer, the term of this patent is extended or adjusted under 35 U.S.C. 154(b) by 0 days.

(21) Appl. No.: 09/171,142

(22) PCT Filed: May 2, 1997

(86) PCT No.: PCT/EP97/02498

§ 371 (c)(1),
(2), (4) Date: Oct. 9, 1998

(87) PCT Pub. No.: WO97/42562

PCT Pub. Date: Nov. 13, 1997

(30) Foreign Application Priority Data

May 8, 1996 (GB) ..... 9609620

(51) Int. Cl.[7] ..... G09G 5/00
(52) U.S. Cl. ..... 345/211; 345/212; 345/213
(58) Field of Search ..... 345/13, 14, 211–214; 323/282–286

(56) References Cited

U.S. PATENT DOCUMENTS 4,930,062 A * 5/1990 Yamada ..... 363/55
5,255,152 A * 10/1993 Estes, III et al. ..... 361/160
5,389,952 A * 2/1995 Kikinis ..... 345/212
5,486,726 A * 1/1996 Kim et al. ..... 307/120
5,633,787 A * 5/1997 Song ..... 363/21
5,745,105 A * 4/1998 Kim ..... 345/212
5,786,813 A * 7/1998 Kurikko ..... 345/212
5,939,803 A * 8/1999 Frost ..... 307/126

FOREIGN PATENT DOCUMENTS

DE 195 25 439 2/1996
EP 0 709 764 5/1996

* cited by examiner

*Primary Examiner*—Bipin Shalwala
*Assistant Examiner*—David L Lewis
(74) *Attorney, Agent, or Firm*—Lee, Mann, Smith, McWilliams, Sweeney & Ohlson

(57) ABSTRACT

A video display unit includes a built-in switched mode power supply and control means, responsive to the presence of one or more active sync signals (Hsync, Vsync), to switch on the display unit from the DPMS OFF mode, in which it consumes a minimum amount of power and to which it is switched in the absence of any active sync signal. Peak sensing circuitry detects that at least one sync signal is active, when switch is closed. A switch disconnects the SMPS controller from the start-up power source until the optocoupler is driven.

6 Claims, 4 Drawing Sheets

22, base
23
Dx9
Dx10
Tx4
BC 547B
Rx13 100k
Rx12 15k
Cx5 47u
Rx11 15k
Cx1 22u
Tx3
BC 547B
Rx9 47k
C21, positive terminal
Rx14 820k
Rx15 820k
DZx1 10V
Rx10 150k
ICx1
5
4
Rx3 2M2
Cx3 100n
Dx3
+5V
+7V
Tx1
BC 557B
Dx8
Rx4 15k
Rx5 100k
Tx5
BC 547B
+15V
Rx16 15k
DZx2 10V
Rx17 15k
1
2
Rx8 100
Tx2
BC 547B
Rx6 10k
Rx7 100k
BAT 42
BAT 42
Dx1
Dx2
Dx5
Dx4
Dx7
Dx6
Cx1 100n
Cx2 100n
Rx1 100
Rx2 100
ICx2
&
To other users
+5V
Hsync
Vsync
N.C.
14
7

VIDEO DISPLAY UNIT WITH SWITCHABLE MODE POWER SUPPLY RESPONSIVE TO ACTIVE SYNC SIGNALS

This invention relates to video display units, in particular computer displays/monitors.

In order to minimise power consumption of desktop computers, a display power management signalling (DPMS) standard has been defined by VESA (Video Electronics Standards Association). This aims to provide a common definition and methodology in which the display controller sends a signal to the display that enables it to enter various power management states. Four states are defined, "ON", "STAND-BY", "SUSPEND" and "OFF". "ON" refers to the state of a display when it is in full operation. "STAND-BY" is an operating state of minimal power reduction and with the shortest recovery time. "SUSPEND" refers to a level of power management in which a substantial power reduction is achieved by the display. A longer recovery time from this state is permitted than from the Stand-by state. "OFF" indicates that the display is consuming the lowest level of power and is non-operational. Normally a monitor in the DPMS OFF state consumes a few watts, typically 3–5W. This consumption is necessary for "watching" the sync signals and to make automatic "wake-up" possible. The present invention is, however, aimed at providing means whereby the power consumption in the DPMS OFF mode is reduced to almost zero, but the display can still be "woken up" from this mode when the sync pulses are reapplied, this being achieved in a manner which is such that a number of somewhat contradictory requirements are fulfilled. The requirements are (i) that the sync inputs must be fully TTL-compatible, in order to ensure no overloading, (ii) that there is full DPMS compatibility ie must wake up even if just one of the sync signals is active, with a worst-case duty cycle and polarity and (iii) that this is achieved at moderate cost.

In GB 2264848 (ICL Personal Systems Oy) there is described a video display with remote power switching. The video display unit has a built-in power supply and at least one electrically controllable power switch for connecting mains voltage to the power supply. A control circuit closes and opens the power switch, for switching on and off the display unit, in response to the state of at least one video or deflection signal received by the display unit, or a command received via a communications channel utilising the signals of the video interface. By this means it is possible to automatically switch on the display unit at the same time as the control unit (processor) is started. In GB 2264848 this is achieved by rectifying at least one video or deflection signal, charging a capacitor with the rectified signal and generating a start-up current pulse from the capacitor. The pulse is supplied to the power switch, which when closed connects mains power to the power supply. In other words, power for the switching is taken from the sync signals, rectified, voltage doubled and applied to solid state relays comprising the switch. Whilst this is simple in principle there are difficulties associated with it. If the duty cycle of the syncs is low, the voltage doubler will take a long time to charge. The solid state relays need to be very sensitive and in any event they are expensive.

In EP A2 0709764, there is disclosed a power supply system, including a source control circuit for operating a CRT display unit, which is capable of reducing power consumption during an interruption of an external input signal given to the power supply system. A holding circuit of a power control circuit is operable in response to such an interruption to de-energise the source control circuit and is put into a self-holding state to maintain a stop mode of the source control circuit, until the external input signal is received again. The circuitry described enables the electric power to be reduced to the order of 5 watts.

In DE A1 195 25 439, there is disclosed another energy-saving circuit for a display apparatus, which controls turn on and/or off of an AC voltage supply and without the need for an auxiliary power supply. This arrangement is such that the electric power is reduced to below 1 watt.

The present invention aims to achieve automatic awakening from the DPMS OFF mode in an alternative and cost-advantageous manner, and which permits almost zero power consumption in that mode.

According to the present invention there is provided a video display unit comprising a built-in power supply including electronically-controllable switch means, and control means responsive to the presence of at least one active video or deflection signal received by the display unit to switch on the display unit by appropriate control of the switch means, the switch means being controlled in response to power extracted from the at least one active signal, and the control means including peak sensing circuits for extracting power from the at least one signal, said peak sensing circuits comprising a respective diode/capacitor combination for each video or deflection signal, and ac sensing circuits for detecting if the at least one signal is active or not, characterised in that the ac sensing circuits comprise a respective capacitor/diodes combination for each video or deflection signal.

Embodiments of the invention will now be described with reference to the accompanying drawings, in which.

Figure 1:
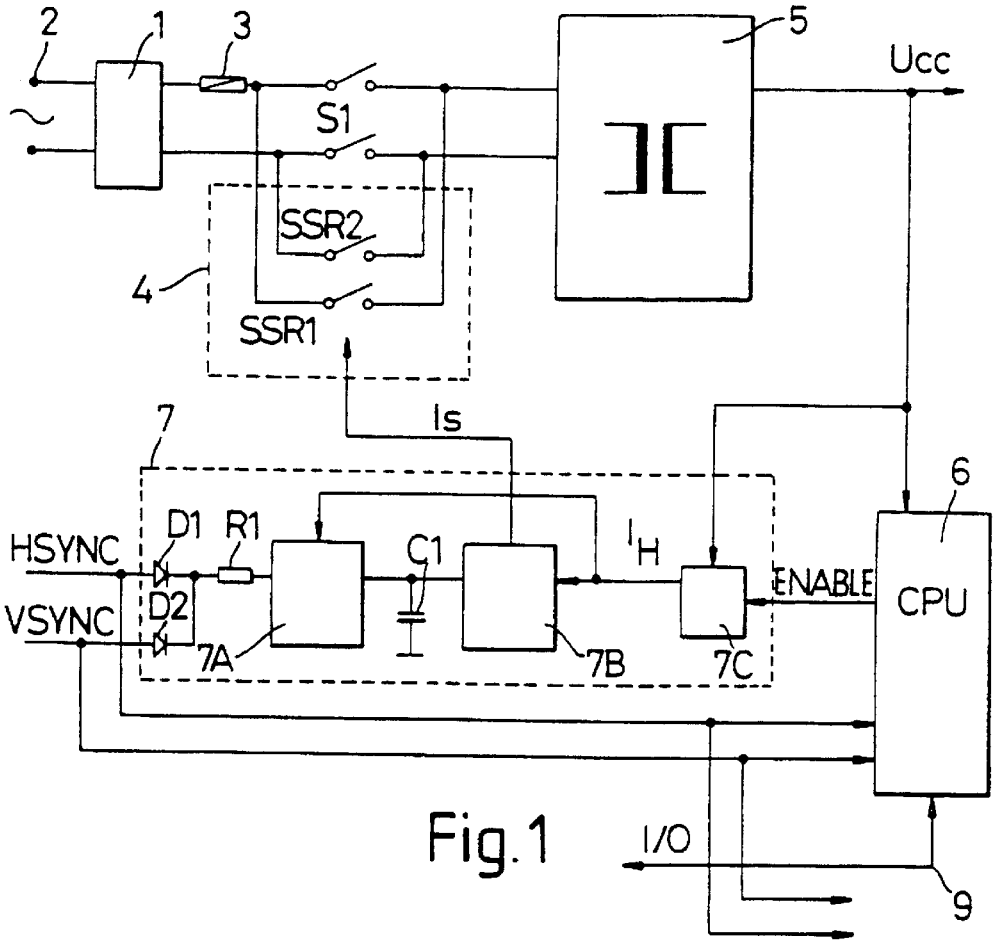
FIG. 1 illustrates a prior art arrangement.

Referring firstly to FIG. 1, which illustrates the known arrangement disclosed in GB 2264848, a circuit for switching on and off a display (not shown) comprises a power supply unit 5 connected via an electrically controllable power switch 4, a fuse 3, a mains filter 1 and a mains connection 2 to an AC mains voltage eg 220 or 110V. The power switch 4 is controlled electrically by a signal Is and may be any electronic or electromechanical switch meeting the electrical specification. As illustrated separate solid state relays SSR1 and SSR2 are employed. A manual power switch S1 is indicated in parallel with switch 4 for use in case of failure of switch 4. When switch 4 is switched on by control current Is, mains voltage is connected to the power supply 5, which generates the various operating voltages required in the video display unit and represented commonly by the single voltage Ucc. Circuit 7 is a start-up and holding circuit with an associated control unit CPU 6. Operating voltage is supplied by the power supply 5 to circuit 7 and a control unit 6, which latter monitors the deflection signal lines HSYNC and VSYNC and generates an operation enable signal ENABLE for circuit 7 when the deflection signals are present. The ENABLE signal actuates a hold current circuit 7C so that it enables the passage of a hold current $I_H$ from power supply 5 to a driver 7B, for the power switch 4, which derives drive current IS from the hold current $I_H$. When the control unit 6 detects the absence of the deflection signals, it eliminates the signal ENABLE after a predetermined delay. Due to the absence of the signal ENABLE, hold current circuit 7C blocks the passage of $I_H$ to driver 7B, hence $I_S$ ceases and power switch 4 is turned off (opened) and the supply 5 disconnected from the mains voltage. Thus, there are no operating voltages in circuit 7 and control unit 6, which cannot therefore monitor the deflection signals when the power switch 4 is open. The energy required to switch on the display unit is derived directly from the deflection signals when they reappear.

For this purpose circuit 7 comprises rectifier diodes D1 and D2 for the half-wave rectification of the deflection signals HSYNC and VSYNC respectively and for charging capacitor C1 by the rectified signals. As the voltage level of the deflection signals is relatively low, a voltage up-converter, such as a voltage doubler 7A, is provided in order to get a sufficient voltage level for the subsequent circuits. The energy level charged in the storage capacitor C1 is monitored by a comparator circuit, in driver circuit 7B, which outputs the current pulse $I_S$ for closing the power switch 4.

Figure 2:
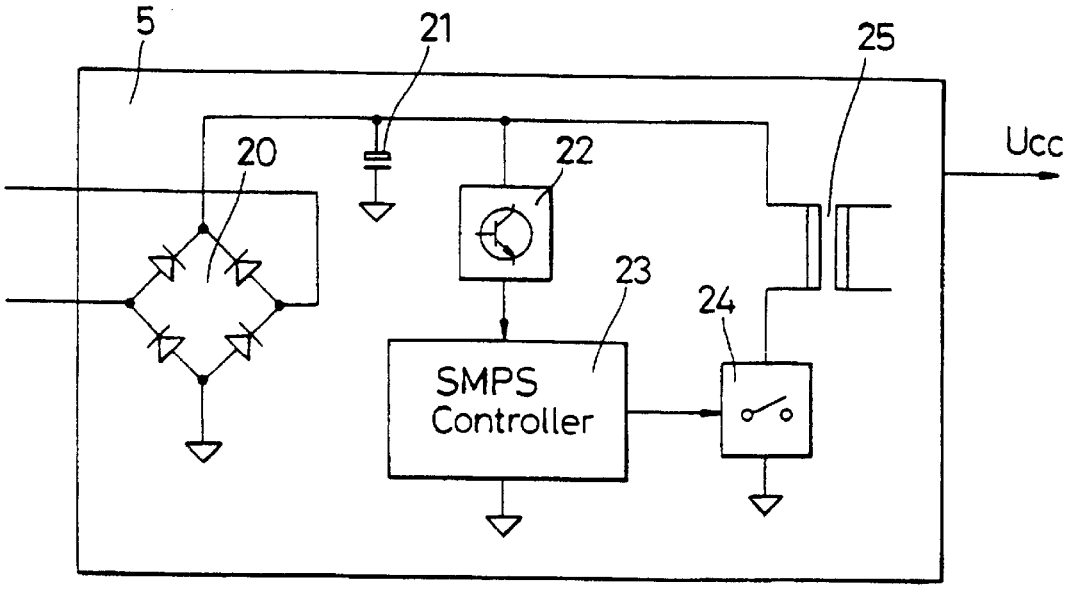
FIG. 2 illustrates a simplified diagram of switched mode power supply SMPS corresponding to supply 5 of FIG. 1

The power supply unit 5 may be comprised by a built-in switched mode power supply SMPS as illustrated schematically in FIG. 2. Apart from switch (transistor) 22 this is commonly used in present day monitors. The SMPS comprises a bridge rectifier 20 which charges a tank capacitor 21. Transistor 22 delivers start-up power to the SMPS controller 23, which rapidly opens and closes electronic switch 24. The precise timing of this is controlled so as to drive the transformer 25 correctly, ie such that transformer 25 delivers correct secondary DC voltages at all times, in spite of varying secondary loads. FIG. 2 is only a schematic illustration and omits various rectifying diodes and capacitors on the secondary side of the transformer, which in reality has several different windings, rather than just one primary and one secondary as illustrated. Transistor 22 is not provided in the SMPS for all monitors, it is however necessary for the wake-up circuitry of the present invention and must be added if not already present as it is required for switching off the start-up power supply to controller 23, as will be appreciated from the following.

In the known arrangement disclosed in GB 2264848, the sync signals are employed to cause switch 4 to be closed in a substantially direct manner ie they are rectified, voltage doubled and resultant pulses applied to relays in order to cause closure of a switch. The present invention achieves the same effect but in a different and somewhat indirect manner, which is able to operate with worst case scenario sync signals, and switch on the monitor even when the latter is provided with lower power levels than hitherto in the DPMS "OFF" mode, referred to hereinafter as near-zero watts. Hence the proposed switching solutions results in even more power efficient (power saving) monitors than hitherto.

The present invention achieves this, in part, by use of an optocoupler ie the sync signals are used to drive a light emitting device and the emitted light is detected, the output signal of the detector being used to achieve the switching.

Figure 3:
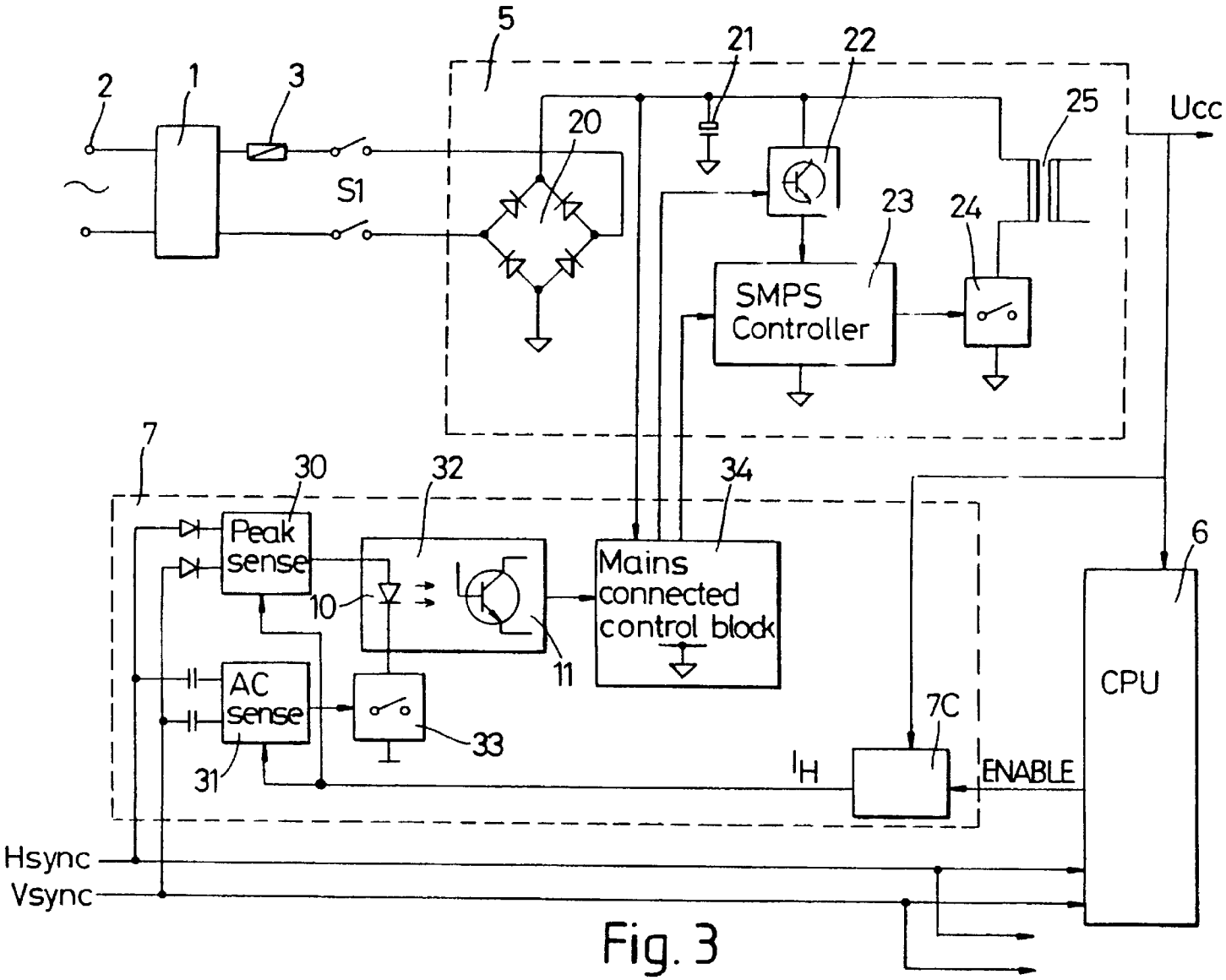
FIG. 3 illustrates, schematically, wake-up circuitry of the present invention in combination with an SMPS and other ancillary elements.

In FIG. 3, which uses the same reference numerals as FIGS. 1 and 2 where appropriate, the optocoupler is an integrated circuit 32 which includes an LED 10 and a photodetector 11. The elements of the circuit coupled to the LED 10 and comprising substantially the left half of the circuit 7 are not mains connected. This left half of the circuit must activate the optocoupler 32 when one or both sync signals (Hsync, Vsync) are active. The peak sensing circuits 30, comprised by diode Dx1 and capacitor Cx3 and diode Dx2 and capacitor Cx3 of the specific embodiment illustrated in FIG. 4, can extract enough power from the sync signals to drive the optocoupler, but they cannot distinguish between an active sync signal and one that is inactive and high. AC-sensing circuits 31, comprised by capacitor Cx1 and diodes Dx4 and Dx5, or capacitor Cx2 and diodes Dx6 and Dx7, in FIG. 4, can recognise an active sync signal correctly, but they cannot extract enough power for the optocoupler if the sync signal is weak. Thus both types are needed; the peak-sensing circuits 30 deliver the power, and the AC-sensing circuits 31 open switch 33 (transistor Tx2 in FIG. 4) at active sync signals, in order to cause the LED 10 to emit light when the sync signals are active.

If an external sync driver, ie the drivers producing the sync signals Hsync and Vsync, is as weak as worst-case TTL specifications allow, then the optocoupler will nevertheless be driven safely, but a sync signal may be overloaded in the sense that it becomes too poor for other users in the monitor. This is of no consequence provided that the overloading is removed when the monitor has woken up. This overload removal can be achieved by means of diode Dx3 and transistor Tx1 of FIG. 4 as described in greater detail hereinafter.

As is apparent from FIG. 3, the output of the photodetector 11 is applied to a mains connected control block 34 which is coupled to SMPS 5. Block 34 is supplied from the tank capacitor 21 and controls the transistor/switch 22 and the SMPS 23. As in FIG. 1, block 7C represents the circuits that remove the loading of the sync signals and is shown, for simplicity, as delivering just a single hold current $I_H$.

The elements of the specific embodiment illustrated in FIG. 4 and so far not referred to will now be discussed. As mentioned above, the sync signal overload can be removed by means of diode Dx3 and transistor Tx1.

The "+5V" supply is the ordinary 5V supply of the monitor and through diode Dx3 it replaces the currents from the peak-sensing circuits when the monitor has been woken up. The "Heater" supply is the heater supply for the monitor, which is also available when the monitor has been woken up. At DPMS "0N", "STAND-BY" and "SUSPEND", the "Heater" supply is sufficiently higher than "+5V" to ensure that Tx1 is supplying current through diode Dx8, thus replacing the currents from the AC-sensing circuits. At DPMS "OFF", when the monitor's microprocessor 6 (FIG. 3) discovers that both sync signals have gone inactive, the microprocessor turns off the heater voltage and as a result the transistor Tx2 is rendered non-conductive, ie switch Tx2 is closed. The monitor is turned off as a result of this, and when the "+5V" supply drops, the microprocessor will eventually lose control and might turn on the "Heater" supply again. However, when this happens the "Heater" supply can be guaranteed to be (arranged to be) too close to "+5V" to be able to open Tx1.

Figure 4:
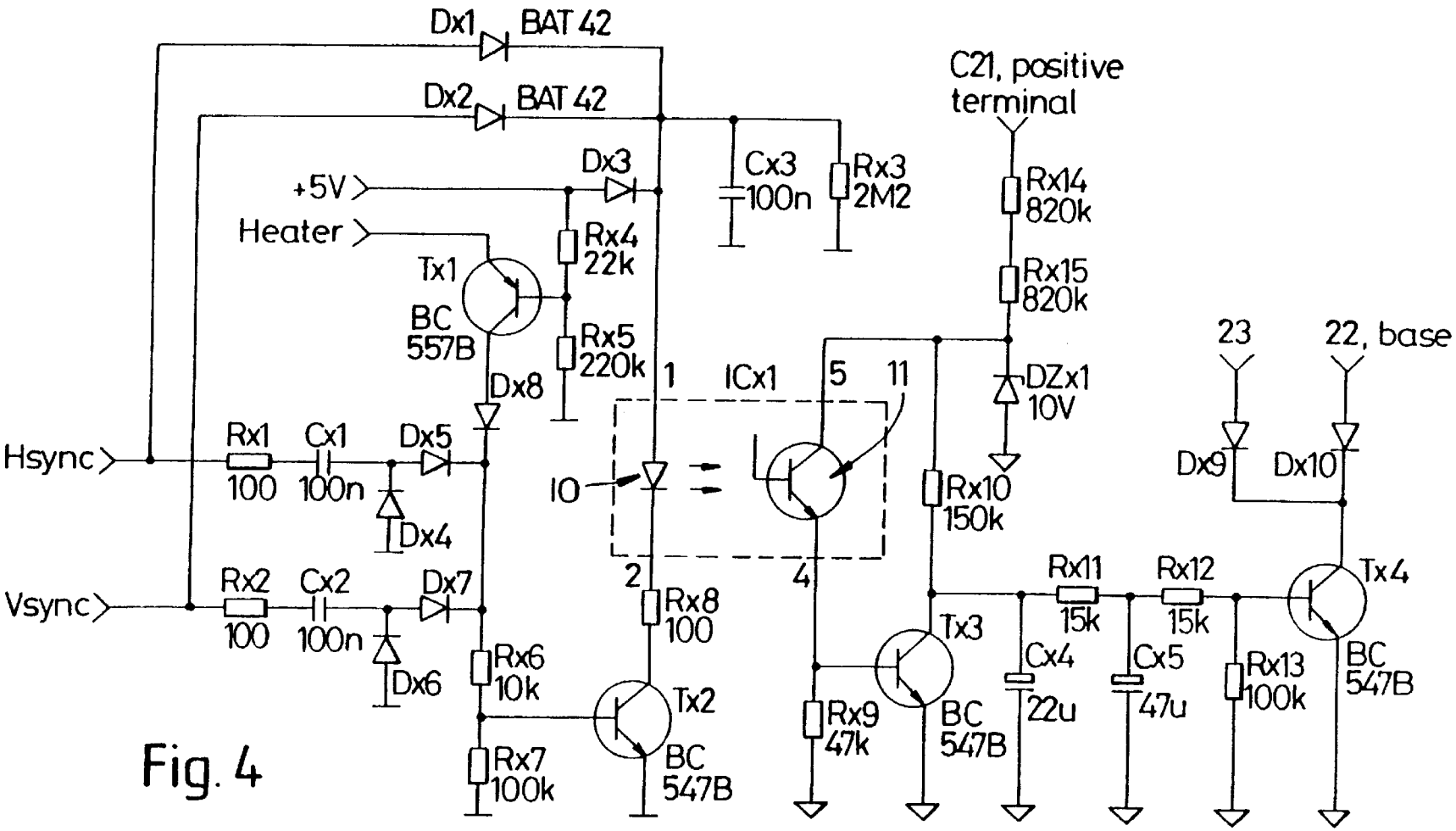
FIG. 4 illustrates a specific embodiment of wake-up circuitry of FIG. 3 in more detail.

The right half of the circuit of FIG. 4, those elements connected to the photodetector 2, is the mains connected control block 34 of FIG. 3 and is required to turn off the monitor when the optocoupler is not active, and to turn on the monitor when the optocoupler is active. Since the optocoupler 32 is mains connected the actual device employed must be approved for mains application. The working power for this half of the circuit is obtained from the positive terminal of the power supply's tank capacitor 21, as described above. This is around 300 VDC at 230 VAC, or 150 VDC at 110 VAC. This power is present whenever the monitor is mains connected with its power switch on (closed), Zener diode DZ1 limits the used voltage to 10V.

When the optocoupler is activated, transistor Tx3 quickly discharges capacitor Cx4. It should be noted that the current through the optocoupler photodetector 11 may pull the voltage over Zener diode DZx1 down from 10V to almost 0, but that only speeds up the discharging of capacitor Cx4 even further. As the charge current (through resistor Rx10 when transistor Tx3 is off) is very much smaller than the discharge currents (when Tx3 is on), the voltage over Cx4 will remain very close to 0 even when discharge occurs at an extremely small duty cycle. It should be noted that Vsync pulses may activate the optocoupler during a very small fraction of each vertical period. The low voltage over Cx4 keeps transistor Tx4 turned off, so that the monitor's SMPS 5 can operate normally.

When both sync pulses are inactive, the optocoupler is inactive and Cx4 is charged, so that transistor Tx4 starts to conduct. Diode Dx9 stops the SMPS controller 23 by pulling down its connected pin (pin 1 in the case of UC3842), thus turning off the monitor. As the normal power supply to the controller 23 is turned off too, the controller 23 could start to consume a lot of power, despite being turned off, from its start-up supply circuit. This is prevented by diode Dx10, which turns off that supply when Tx4 is conducting.

The main function of the filter comprised by resistor Rx11 and capacitor Cx5 is to prevent spurious sync pulses and other kinds of noise from temporarily turning on the monitor when it is on the DPMS "OFF" mode. Capacitor Cx4 is not able to provide that filtering as it discharges too quickly when Tx3 is on, as described above.

Capacitors Cx4 and Cx5 also support the (optional) override capability, defined in the DPMS standard.

If the monitor has been disconnected from the mains for about 7 minutes or more, as a result of the power switch being turned off or the mains plug pulled out, then the tank capacitor 21 will have discharged enough so that capacitors Cx4 and Cx5 are also discharged to low voltages. If the monitor is then started without sync pulses, transistor Tx4 will stay off long enough to give the microprocessor 6 time to discover the absence of the sync pulses and set the override mode, which includes enabling "Heater" so that the optocoupler is actuated and keeps the monitor on. The components of FIG. 4 may comprise the following, for example, for a typical monitor (our designation 151*p*).

| | |
|---|---|
| 32 | H11AV1 or CNY17F-3 or other equivalent optocoupler with a current transfer ratio of ≧100% at IF = 10 mA and approved for mains applications |
| Tx1 | BC557B or equivalent SMD type |
| Tx2–Tx4 | BC547B or equivalent SMD type |
| Dx1–Dx2 | BAT42 (Schottky) |
| Dx3–Dx10 | BZX55C 10 or equivalent |
| Cx1–Cx3 | 100 nF, plastic |
| Cx4 | 22 μF ± 20% ≧ 10 V, electrolytic |
| Cx5 | 47 μF ± 20% ≧ 10 V, electrolytic |
| Rx1-14 Rx15 | Values as indicated FIG. 4, tolerance 5%. Power class 1/10 W for Rx8, 1/16 W for all others Rx14 and Rx15 rated for 200 VDC |

Using the above components with a 151*p* monitor, the power consumption in the DPMS "OFF" mode was of the order of 0.25W at 230 VAC, and less than 0.1W at 110 VAC.

Figure 5:
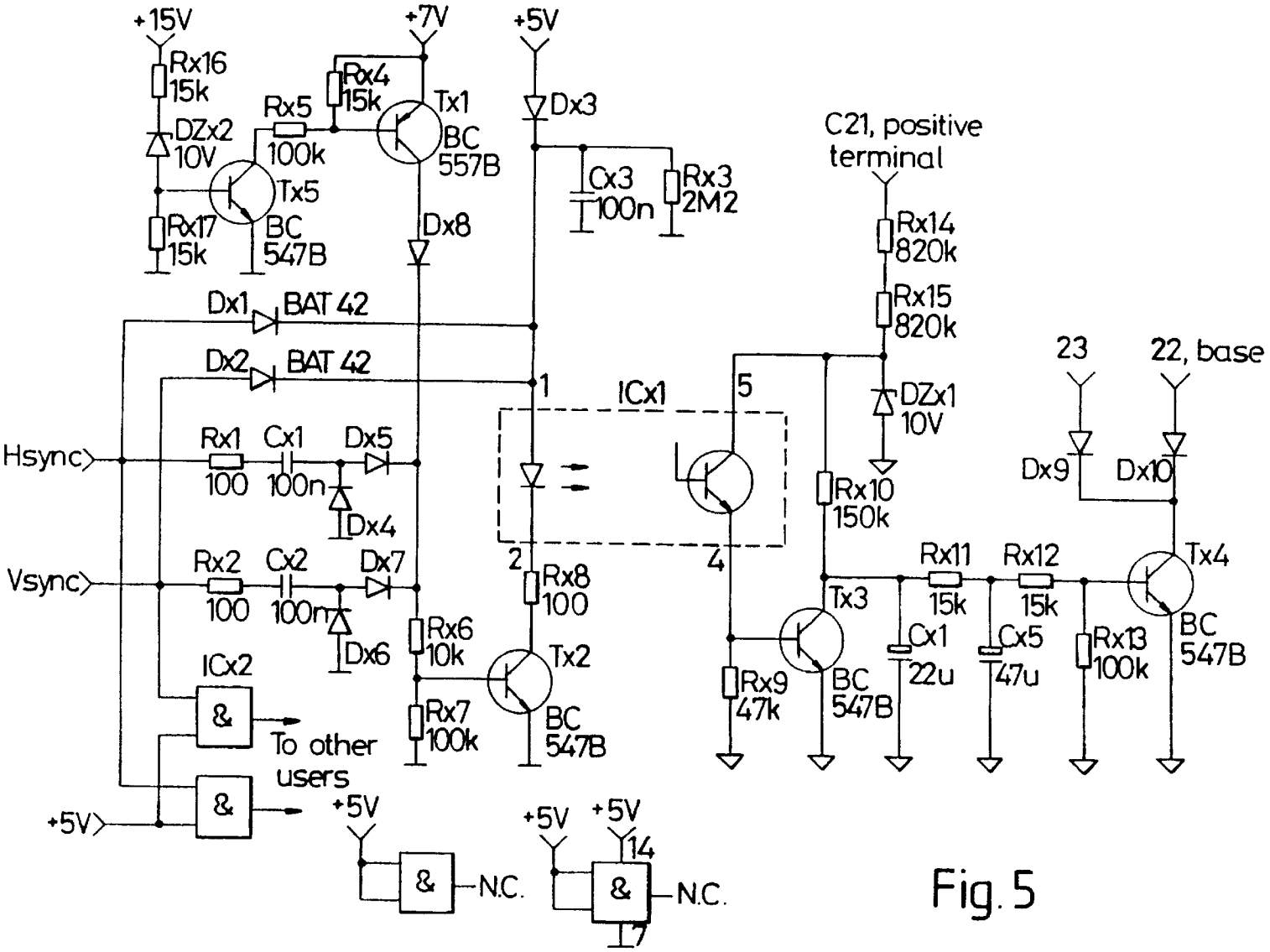
FIG. 5 illustrates another specific embodiment of wake-up circuitry of FIG. 3 in more detail.

Essentially the same principal as employed in FIG. 4 for our 151*p* monitor is also applicable to other monitors. FIG. 5 shows a circuit diagram for our 172*p* monitor, which employs a different design philosophy. The circuit of FIG. 5 has the following additional components: IC2, transistor Tx5, zener diode DZx2, resistor Rx16, and resistor Rx17. Transistor Tx1 is connected in a slightly different way in FIG. 5 to that in FIG. 4.

In the $^{151}p$ monitor, all of the other users of the sync pulses are such that they do not present any load to the sync pulses when the monitor is off. However, in the 172*p* monitor and many other monitors, the sync pulses will be clamped down to unacceptable levels when the monitor is off, unless a non-clamping buffer like 74LSxx or 74Fxx is inserted. Buffers 74HCxx and 74HCTxx clamp in unpowered mode and cannot be used. Hence the use of IC2, which comprises four AND gates in the case of a 74L508 and can be connected as shown. The use of an additional IC2 is not essential, the same effect could be achieved by appropriate redesign of the monitor's circuitry.

Together with the additional components, transistor Tx1 performs the same function as transistor Tx1 in FIG. 4, although for slightly different conditions. "+7V" is the heater supply. At DPMS "ON", "STAND-BY" and "SUSPEND", both "+7V" and "+15V" are on. At DPMS "OFF", when the monitor's processor discovers that both sync signals have gone inactive, it turns off the "+7V", thus closing switch Tx2 (rendering transistor Tx2 non-conductive) so that the LED is not powered. The monitor is turned off as a consequence of this and when "+5V" drops, the microprocessor will eventually lose control and might turn on "+7V" again. However, when that happens, the "+15V" supply is guaranteed to be too low to open Tx1 via Tx5.

Whilst two specific circuit versions of the invention have been described above they are essentially the same. The only differences are related to the circuitry of the monitors with respect to which they have been described, namely our designations 151*p* and 172*p*. The basic arrangement can of course be applied to other monitors.

These particular modifications are those appropriate to the particular types of monitors in connection with which the present invention has been described.

The person skilled in the art and employing the invention with other monitors will readily appreciate what if any modification it will be necessary to make to associated circuitry in order to achieve the desired "almost zero" power state.

Typical components for the circuitry of FIG. 5 are the same as indicated above for FIG. 4 except where previously mentioned, and as below: Tx5 is also a BC547B (or equivalent SMD type), DZx2 is also a BZX55C10 or equivalent and Rx16 and Rx17 have the values indicated with a tolerance of 5%, and power class 1/16W.

As will be appreciated from the above, it is possible as a result of the described circuitry to switch the power off/on via direct control of the SMPS controller 23. Hence components like TRIACs and primary-side power-supply ICs are not needed, with resultant cost saving possibilities. The manually operated switch S1 in FIG. 3 will, of course, always need to be in the closed state for this direct control, and will only be in the illustrated open state when the monitor is entirely out of use.

Controlling the SMPS controller directly, as described above with reference to FIGS. 3, 4 and 5, saves a lot of money. The relays of GB 2264848, whether solid-state or electromechanical relays, are expensive. Electromechanical relays of low or moderate cost cannot withstand the large inrush currents at power up of monitors, and a solid-state solution designed to survive safely at power-up would be even more expensive, whether built with complete solid-state relays or TRIACs etc. It is also considered very unlikely that a relay solution could be implemented without an extra "mini" power supply, because of the very limited power that can be extracted from the sync signals.

In view of the DPMS standard requirements, the sync signal detection principle of GB 2264848 is no longer usable. Using only a peak sensing circuit, as in GB 2264848, was possible before the DPMS standard when it was acceptable to assume that inactive signals should be kept at low level. The DPMS standard, now widely accepted and used, allows inactive sync signals to be kept at either level. A peak sensing circuit cannot distinguish between an active signal and one that is inactive and high. The present near-zero watts implementation solves this problem by combining a peak sensing circuit, which extracts the required power, with an AC sensing circuit. Furthermore, the near-zero watts implementation is, unlike GB 2264848, fully TTL compatible. GB 2264848 assumes that the sync-signal source can supply at least 1 mA at 2.7V. However, many video boards use a standard 74LS gate (eg 74LS04) as sync driver, and such a driver is only guaranteed to source 0.4 mA at 2.7V. The near-zero watts implementation is compatible with such sources, as well as other TTL sources.

What is claimed is:

1. A video display unit comprising:

(a) a built-in power supply;

(b) electronic control means for switching the power supply on and off;

(c) a peak sensing circuit for extracting power solely from at least one video or deflection signal received by the display unit;

(d) an ac sensing circuit for detecting when said signal is active; and (e) means, controlled by said ac sensing circuit, for applying said power from said peak sensing circuit to said electronic control means to switch said power supply on when said signal is active.

2. A video display unit according to claim 1 wherein said electronic control means is connected to the input side of said power supply, to receive mains power even when said power supply is switched off by said electronic control means.

3. A video display unit according to claim 1 wherein said electronic control means includes an optocoupler.

4. A video display unit according to claim 3 wherein said means for applying said power from said peak sensing circuit to said electronic control means comprises means for applying said power to said optocoupler.

5. A video display unit according to claim 1 wherein said peak sensing circuit comprises a respective diode/capacitor combination for each video or deflection signal.

6. A video display unit according to claim 1 wherein said ac sensing circuit comprises a respective capacitor/diodes combination for each video or deflection signal.

* * * * *